United States Patent [19]

Neill et al.

[11] 4,029,341

[45] June 14, 1977

[54] PRINTED FORM HAVING REMOVABLE LABEL

[75] Inventors: Jimmie D. Neill, Hatboro, Pa.; Lester V. Wise, Old Westbury, N.Y.

[73] Assignee: Federal Business Products, Inc., New York, N.Y.

[22] Filed: Apr. 2, 1976

[21] Appl. No.: 672,969

[52] U.S. Cl. ..... 282/22 R; 40/2 R; 283/21; 282/1 R; 282/28 R

[51] Int. Cl.[2] ..... B41L 1/24

[58] Field of Search ..... 282/23 R, 22 R, 28 R, 282/1 R, 1 A; 283/1 A, 21; 40/2 R

[56] References Cited

UNITED STATES PATENTS

| | | | |
|---|---|---|---|
| 1,480,938 | 1/1924 | Halladay | 282/28 R |
| 3,075,791 | 1/1963 | Wolf | 282/1 R |
| 3,208,771 | 9/1965 | Sichel | 282/22 R |
| 3,383,121 | 5/1968 | Singer | 282/28 R |
| 3,822,492 | 9/1974 | Crawley | 40/2 R |

FOREIGN PATENTS OR APPLICATIONS

| | | | |
|---|---|---|---|
| 2,312,276 | 9/1974 | Germany | 282/22 R |
| 1,176,986 | 8/1964 | Germany | 282/23 R |

*Primary Examiner*—Jerome Schnall

[57] ABSTRACT

A printed form to be filled out and submitted to a receiving party for processing, the form including as a removable component thereof a label assembly on which the submitter inserts his name and address, whereby the receiving party is then able to mail material to the submitter in an envelope having the removed label applied thereto. The label assembly is constituted by a face sheet having an address block printed thereon which is to be filled out with the name and address of the submitter, the underside of the face sheet having a pressure-sensitive adhesive layer thereon protectively covered by a backing sheet. The backing sheet is severed into two short end sections and a long intermediate section, the underside of the intermediate section having a carbon copy coating thereon. In attaching the label assembly to the form to overlie an address block printed thereon, the end sections of the backing are adhered to the corresponding ends of the form block. Since the intermediate section is not adhered to the form block, the margins thereof are free and one can, therefore, detach the face sheet label from the form and then peel off the carbonized intermediate section and adhesively apply the label to the envelope.

4 Claims, 6 Drawing Figures

Fig. 1.

BIG DEAL CORPORATION AND SUBSIDIARY CO

B1 CLAIM FOR DENTAL EXPENSE

X INSURANCE CO.

B2

PATIENT NAME | RELATIONSHIP TO EMPLOYEE | SEX | BIRTHDATE | STUDENT | CITY

EMPLOYEE NAME | EMPLOYEE SOC. SEC. NO | NAME OF GROUP DENTAL PROGRAM: BIG DEAL CORP AND SUBSIDIARY CO.

EMPLOYEE ADDRESS | EMPLOYER WORK LOCATION

CITY STATE ZIP

GROUP NUMBER | ARE OTHER | NAME AND ADDRESS OF EMPLOYER

IS PATIENT COVERED BY ANOTHER PLAN | PLAN NAM | UNION LOCAL GROUP NUMBER | CARRIER

B5

SIGNED | DATE | SIGNED | DATE

DENTIST NAME

MAILING ADDRESS

CITY STATE ZIP

DENTIST S.S. OR | DENTIST PHONE N

B4

B3

LINGUAL

PRIMARY

RIGHT

UPPER

LOWER

FACE

INDICATE

I HEREBY CERTIFY

SIGNED

10

12

11

PRINTED FORM HAVING REMOVABLE LABEL

BACKGROUND OF INVENTION

This invention relates generally to printed forms for processing claims, and more particularly to a printed form having an address label removably attached thereto, whereby material to be returned to the submitter of the form by the receiving party may be enclosed in an envelope which is addressed by the removed label.

While the invention will be described herein in connection with printed forms for processing claims for dental expense benefits, it is to be understood that the invention is applicable to any printed form which is to be submitted to a party for processing, which processing requires the mailing of material by the receiving party to the submitter.

Certain insurance companies now provide group insurance for the employees of large companies to cover their dental expenses. Thus the dentist who treats an employee covered by a policy of this type is not paid by his patient for services rendered but by the insurer. In order to receive payment, the dentist is required to fill out a printed form supplied by the insurer, in which the dentist identifies his patient and indicates in detail the nature of the professional services he has performed.

Since dentists normally take X-rays of the teeth before treatment, the dentist is required to send in these radiographs with the filled-out form so that the insurer is able to check the X-rays before authorizing payment to the dentist. And since the radiographs are the property of the dentist, they must be returned to him by the insurer.

The need to return radiographs or other material to the insurer presents certain practical problems. Under existing procedures, the dentist inserts his name and address in an address block on the printed form, and the insurer, in preparing an envelope for the material to be returned to the dentist, must address this envelope on the basis of information derived from the block. This is a time-consuming operation and subject to human error. Where literally thousands of such forms are processed by an insurance company, existing procedures are not only costly but are a source of frequent complaint from dentists who fail to receive their radiographs and other material because of improper addressing on the part of clerical personnel.

SUMMARY OF INVENTION

In view of the foregoing, it is the main object of this invention to provide a printed form having a removable label assembly attached thereto whereby material returned to the submitter of the form by the receiving party may be sent in an envelope which is addressed by the removed label.

Thus a form having a label assembly component in accordance with the invention obviates the need for clerical personnel to address envelopes to be sent to submitters of the form, thereby effecting economies in processing and avoiding the possibility of human error.

Also an object of this invention is to provide a removable address label assembly for a printed form which may be manufactured at low cost on a mass production basis.

More specifically, it is an object of this invention to provide a removable address label assembly for a printed form, which assembly incorporates a carbon copy coating whereby the address inserted by the submitter on the label is reproduced in a corresponding address block printed on the form.

Briefly stated, these objects are accomplished in a label assembly constituted by a face sheet having an address block printed thereon which is to be filled out with the name and address of the submitter, the underside of the face sheet having a pressure-sensitive adhesive layer thereon protectively covered by a backing sheet. The backing sheet is severed into two short end sections and long intermediate section, the underside of the intermediate section having a carbon copy coating thereon.

In attaching the label assembly to the form to overlie an identical address block printed thereon, the end sections of the backing are adhered to the corresponding ends of the form block. Since the intermediate section of the backing is not adhered to the form but to the face sheet, the margins thereof are free, and one can, therefore, detach the face sheet label from the form and then peel off the carbonized intermediate section before pressing the label onto the envelope.

OUTLINE OF DRAWING

For a better understanding of the invention as well as other objects and further features thereof, reference is made to the following detailed description to be read in conjunction with the accompanying drawings, wherein:

FIG. 1 illustrates a printed claim form which includes an address block to be filled out by the submitter;

DESCRIPTION OF INVENTION

The Basic Form

Figure 2:
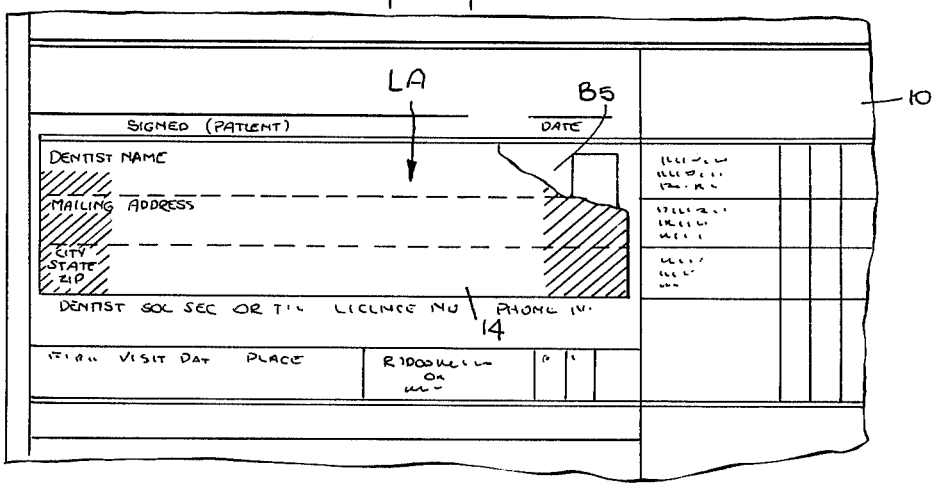
FIG. 2 illustrates the same form having a label assembly component in accordance with the invention overlying the address block and attached thereto.
Figure 3:
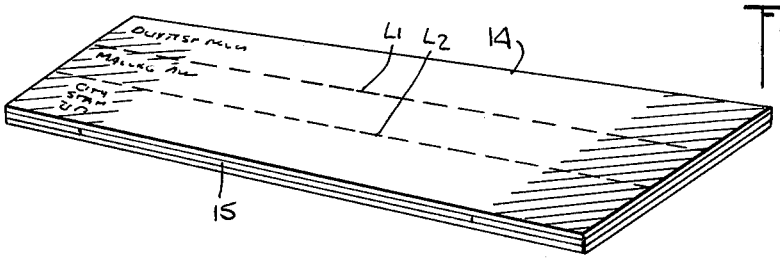
FIG. 3 is a perspective view of the assembly which is sectioned to reveal the various elements thereof.
Figure 5:
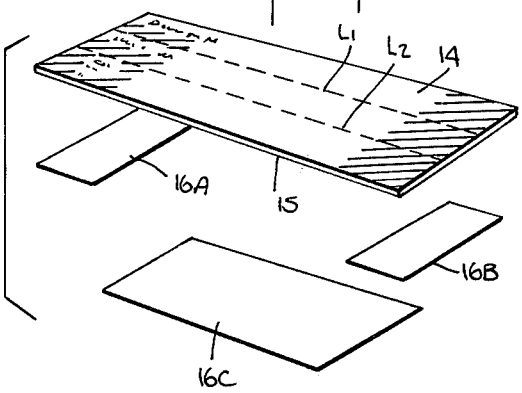
FIG. 5 is an exploded view of the assembly.
Figure 4:
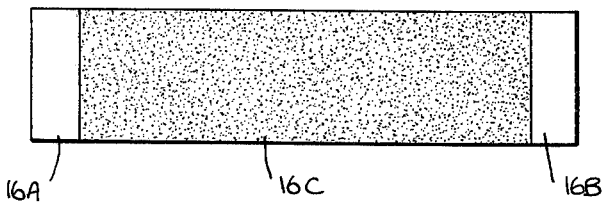
FIG. 4 shows the undersurface of the backing sheet.

Referring now to the drawing, and more particularly to FIG. 1, there is shown a printed form to be used by dentists in filing claims for dental expenses, the filled-out form being thereafter sent to the insurance company issuing the group policy. The form is constitued by an original sheet 10 to be filled out by the dentist and mailed to the insurer, a duplicate sheet 11, which is the dentist's copy, and a carbon sheet 12 interleaved between the orginal and duplicate sheets.

The form is printed to provide various data blocks into which information is to be inserted by the dentist. Thus the form includes a block $B_1$ to identify the employee-patient who has been treated by the dentist, a block $B_2$ to identify the employer of the patient, a block $B_3$ containing a standard pattern of teeth designated by numerals and letters, and a block $B_4$ for describing the services rendered by the dentist in connection with particular teeth identified by numbers or letters.

Also on the form is a three-line data block $B_5$ which is to be filled in with the dentist's name, his mailing address and city and state. The form also requires that the dentist indicate whether radiographs or models are enclosed and how many thereof. This is the material which has to be returned to the dentist by the insurance company after the form has been processed. It is noted that the dental expense benefits form shown in FIG. 1 is the 1975 form approved by the Council on Dental Care Programs of the A.D.A.

It will be appreciated, however, that the present invention is applicable to any printed form which contains an address block similar to block $B_5$ and whose processing requires the mailing of material in an envelope to the party identified in the address block.

The Label Assembly

Referring now to FIGS. 2 to 5, there is shown a label assembly generally designated as LA which overlies the address block $B_5$ on the printed form and is removably attached thereto so that the assembly is a component of the form to be filled out by the dentist.

The assembly is rectangular and has dimensions which substantially match those of the address block printed on the form. It is composed of a label or face sheet 14 having two lines $L_1$ and $L_2$ printed thereon which correspond to the two lines on the printed block $B_5$ on the orignial sheet 10, the lines defining three spaces for insertion of the DENTIST'S NAME, his MAILING ADDRESS, and the CITY, STATE, ZIP.

The rear surface of face sheet 14 is covered with a layer 15 of pressure-sensitive adhesive which, in turn, is protectively covered by a peelable sheet 16. Cover sheet 16, which is laminated to face sheet 14, is severed to define a pair of short end sections 16A and 16B and a relatively large intermediate section 16C whose rear surface is provided with a coating 17 of duplicating carbon which is transferable to the printed form.

End sections 16A and 16B of cover sheet 16 are adhered to the corresponding ends of the address block $B_5$ printed on the form, whereas the intermediate section is free. The end zones 14A and 14B of the face sheet 14 which correspond to the end sections 16A and 16B on the cover sheet are cross-hatched so that the dentist or whoever else fills out the label does not write in the end zones, but only in the area of the face sheet corresponding to the intermediate section 16C which has a carbonized back and therefore reproduces the writing on the face wheet on the address block $B_5$.

After the face sheet is filled out and the writing reproduced in address block $B_5$, it can readily be detached from the printed form, since the intermediate section of the cover sheet is not adhered to the form and a fingernail may be inserted under its margin to pull the intermediate section 16C and face sheet 14 to which it is laminated.

Figure 6:
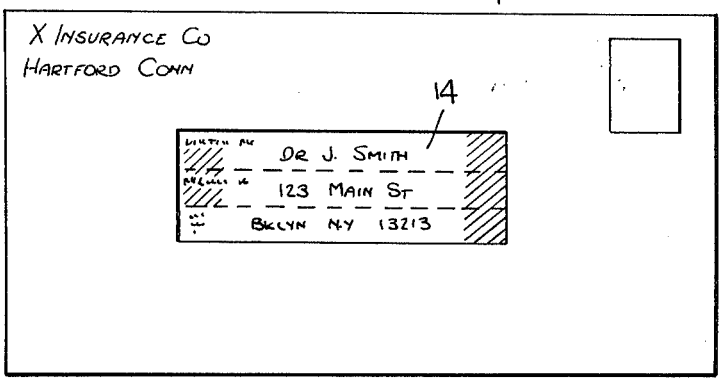
FIG. 6 shows the label applied to an envelope.

Then the intermediate section 16C may be peeled off the face sheet so that now the entire pressure-sensitive adhesive coating thereon is exposed. At this point one may apply the label to an envelope containing the material to be returned to the dentist, as shown in FIG. 6.

In practice, the label assembly may be manufactured in continuous web form with the face sheet web in blank, after which the web is cut into individual assemblies and applied to the address blocks on the printed forms by a suitable dispenser. Before the individual assembly is applied to the address block, spots of liquid adhesive are first impressed in the end zones of the block so that the end sections of the cover sheet are bonded thereto. After the label assembly is attached, an address block is printed on the face sheet 14 by rotary-printing or other operation.

The reason for printing the face sheet of the assembly after the assembly is attached to the form is to avoid problems of registration which would arise should the face sheet be pre-printed.

While there has been shown and described preferred embodiments of a printed form having removable label in accordance with the invention, it will be appreciated that many changes and modifications may be made therein without, however, departing from the essential spirit thereof. Thus while the intermediate section has been described as having a carbon backing, other forms of pressure-responsive duplicating backing may be used. Also, the label is useable for purposes other than names and addresses such as for shelf identification for production control during manufacture or to attach special instructions to an order.

We claim:

1. A printed form having an address block thereon for the entry of name and address data regarding the submitter of the form, said form having a label assembly component overlying the address block, making it possible to send material to the submitter in an envelope addressed by a label detached from the assembly, said assembly comprising:

A. a face sheet having an address block thereon corresponding to the block printed on the form, the underside of the face sheet being covered by a pressure-sensitive adhesive layer; and B. a protective cover sheet laminated to said face sheet by said adhesive layer, said cover sheet being severed into two end section tabs which are adhered to and remain permanently attached to the corresponding end portions of the address block on the form and a relatively long intermediate section having a pressure-responsive duplicating back surface whereby when said data is inserted in the address block on the face sheet, it is reproduced on the printed form, said intermediate section laminated to said face sheet completely covering the adhesive on the underside of the face sheet to form an intermediate laminated portion having adhesive-free edges between said tabs and being readily removable from said form, said intermediate section being thereafter peelable from said face sheet which may then be applied to said envelope.

2. A printed form as set forth in claim 1, wherein said form is composed of an original sheet, a duplicate sheet and a carbon sheet therebetween, whereby the data reproduced on the original sheet also appears on the duplicate sheet.

3. A printed form as set forth in claim 1, wherein the end portions of the face sheet corresponding to the end sections of the cover sheet are cross-hatched to prevent the entry of data on the face sheet in any area other than that corresponding to the intermediate section.

4. A printed form as set forth in claim 1, wherein said pressure-responsive surface is a carbonized layer.

* * * * *